US009893399B2

(12) United States Patent
Cheng et al.

(10) Patent No.: US 9,893,399 B2
(45) Date of Patent: Feb. 13, 2018

(54) WAVEGUIDE FILTER

(71) Applicant: Huawei Technologies Co., Ltd., Shenzhen (CN)

(72) Inventors: Yujian Cheng, Chengdu (CN); Chuanan Zhang, Chengdu (CN); Yi Chen, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 187 days.

(21) Appl. No.: 14/883,309

(22) Filed: Oct. 14, 2015

(65) Prior Publication Data

US 2016/0036110 A1 Feb. 4, 2016

Related U.S. Application Data

(63) Continuation of application No. PCT/CN2013/074208, filed on Apr. 15, 2013.

(51) Int. Cl.

| | |
|---|---|
| ***H01P 1/207*** | (2006.01) |
| ***H01P 7/06*** | (2006.01) |
| ***H01P 5/02*** | (2006.01) |
| ***H01P 1/208*** | (2006.01) |

(52) U.S. Cl.

CPC ..... *H01P 1/207* (2013.01); *H01P 1/2088* (2013.01); *H01P 5/022* (2013.01); *H01P 5/024* (2013.01); *H01P 7/065* (2013.01)

(58) Field of Classification Search

CPC ..... H01P 5/022; H01P 5/024; H01P 1/2002; H01P 1/2088; H01P 1/207; H01P 7/065

USPC ..... 333/208, 227

See application file for complete search history.

(56) References Cited

U.S. PATENT DOCUMENTS

| | | | | |
|---|---|---|---|---|
| 4,291,288 | A | 9/1981 | Young et al. | |
| 7,907,031 | B2 * | 3/2011 | Kim | H01P 5/1022 333/21 R |
| 2004/0183627 | A1 | 9/2004 | Lo Hine Tong et al. | |
| 2007/0120628 | A1 | 5/2007 | Jun et al. | |

FOREIGN PATENT DOCUMENTS

| | | | |
|---|---|---|---|
| CN | 1534824 | A | 10/2004 |
| CN | 1331270 | C | 8/2007 |
| CN | 201174412 | Y | 12/2008 |

(Continued)

OTHER PUBLICATIONS

Jingsong, Huang, et al., "Design of Ka Band Multilayer Cross-coupled Filter Based on Substrate Integrated Waveguide," Microwave Workshop Series on Millimeter Wave Wireless Technology and Applications (IMWS), Sep. 18, 2012, 4 pages.

(Continued)

*Primary Examiner* — Rakesh Patel

(74) *Attorney, Agent, or Firm* — Slater Matsil, LLP

(57) ABSTRACT

An embodiment of the present invention discloses a waveguide filter, which includes a first waveguide at an upper layer and a second waveguide at a lower layer. The first waveguide and the second waveguide are isolated from each other by a metal isolation layer. The first waveguide forms a first resonant cavity. The second waveguide forms a second resonant cavity. The first resonant cavity and the second resonant cavity overlap each other. A coupling slot is disposed at the metal isolation layer in an overlapping area.

20 Claims, 3 Drawing Sheets

(56) References Cited

FOREIGN PATENT DOCUMENTS

| | | | |
|---|---|---|---|
| CN | 102361113 | A | 2/2012 |
| EP | 1443588 | A1 | 8/2004 |

OTHER PUBLICATIONS

Tomassoni, Cristiano, et al., "Generalized TM Dual-Mode Cavity Filters," IEEE Transactions on Microwave Theory and Techniques, vol. 59, No. 12, Dec. 2011, pp. 3338-3346.

Zhang, Zhigang, et al., "A Compact Multilayer Dual-mode Substrate Integrated Circular Cavity (SICC) Filter," Microwave Conference Proceedings (CJMW), IEEE, Apr. 20, 2011, 4 pages.

* cited by examiner

WAVEGUIDE FILTER

This application is a continuation of International Application No. PCT/CN2013/074208, filed on Apr. 15, 2013, which is hereby incorporated by reference in its entirety.

TECHNICAL FIELD

The present invention relates to the field of wireless communications technologies, and in particular, to a waveguide filter.

BACKGROUND

A waveguide is an apparatus for transmitting an electromagnetic wave in radio fields such as radio communication, radars, and navigation, and is a basic circuit unit in a circuit system. Generally, a circuit system has multiple waveguides, and therefore, adaptation is required between a waveguide and another waveguide or between a waveguide and another sub-circuit. However, if a filter with a frequency-selecting function, that is, a waveguide filter, is formed in an adaptation process, a quantity of filters in the circuit system may be reduced to some extent.

A waveguide filter commonly used in a microwave and millimeter wave circuit may be filter based on a metal waveguide and a filter based on a planar circuit such as a microstrip line and a coplanar line. The filter based on a metal waveguide generally has advantages such as a high Q value (quality factor), a low loss, and desirable selectivity. The filter based on planar circuit technologies such as a microstrip line and a coplanar line has a feature of easy integration into an active circuit. A filter based on a substrate integrated waveguide has such advantages of a planar circuit as being easily integrated and conveniently manufactured, and also has excellent performance similar to that of a metal waveguide filter.

However, the foregoing waveguides that form a filter are generally disposed at a same layer of circuit. When the waveguides are applied to multiple layers of circuits, an extra transition structure needs to be added to implement inter-layer adaptation, which imperceptibly increases complexity of a circuit structure and a circuit loss.

SUMMARY

An embodiment of the present invention provides a waveguide filter, so as to resolve a problem of a complex circuit structure and a high circuit loss that are caused when a waveguide filter is applied at different layers of circuits.

To achieve the foregoing objectives, the following technical solutions are used in the embodiment of the present invention uses.

A first aspect of the present invention provides a waveguide filter, where the waveguide filter includes a first waveguide at an upper layer and a second waveguide at a lower layer, the first waveguide and the second waveguide are isolated from each other by a metal isolation layer, the first waveguide forms a first resonant cavity, the second waveguide forms a second resonant cavity, the first resonant cavity and the second resonant cavity overlap each other, and a coupling slot is disposed at the metal isolation layer in an overlapping area.

In a first possible implementation manner, the first waveguide includes a dielectric substrate, an upper surface of the dielectric substrate is covered by a first metal layer, a lower surface of the dielectric substrate is covered by a second metal layer, multiple metalized via holes that run through the first metal layer, the dielectric substrate, and the second metal layer are disposed in the dielectric substrate, and the dielectric substrate, the multiple metalized via holes, the first metal layer, and the second metal layer form the first resonant cavity; the second waveguide is a metal waveguide with a pierced upper part, and the second metal layer and a cavity inside the second waveguide form the second resonant cavity; and the metal isolation layer is the second metal layer.

In a second possible implementation manner, the first waveguide includes a first dielectric substrate, an upper surface of the first dielectric substrate is covered by a first metal layer, a lower surface of the first dielectric substrate is covered by a second metal layer, multiple first metalized via holes that run through the first metal layer, the first dielectric substrate, and the second metal layer are disposed in the first dielectric substrate, and the first dielectric substrate, the multiple first metalized via holes, the first metal layer, and the second metal layer form the first resonant cavity; the second waveguide includes a second dielectric substrate, an upper surface of the second dielectric substrate is covered by a third metal layer, a lower surface of the second dielectric substrate is covered by a fourth metal layer, multiple second metalized via holes that run through the third metal layer, the second dielectric substrate, and the fourth metal layer are disposed in the second dielectric substrate, and the second dielectric substrate, the multiple second metalized via holes, the third metal layer, and the fourth metal layer form the second resonant cavity; and the metal isolation layer is the second metal layer and the third metal layer.

In a third possible implementation manner, the first waveguide is a hollow metal waveguide, and a cavity inside the first waveguide forms the first resonant cavity; the second waveguide is a metal waveguide with a pierced upper part, and a metal layer on a lower surface of the first waveguide and a cavity inside the second waveguide form the second resonant cavity; and the metal isolation layer is the metal layer on the lower surface of the first waveguide.

With reference to the first aspect, the first possible implementation manner of the first aspect, the second possible implementation manner of the first aspect, or the third possible implementation manner of the first aspect, in a fourth possible implementation manner, both the first resonant cavity and the second resonant cavity are circular.

With reference to the fourth possible implementation manner of the first aspect, in a fifth possible implementation manner, the coupling slot is located at a central position of the overlapping area, and an extension direction of the coupling slot is perpendicular to a line connecting a circle center of the first resonant cavity and a circle center of the second resonant cavity.

With reference to the first aspect, the first possible implementation manner of the first aspect, the second possible implementation manner of the first aspect, the third possible implementation manner of the first aspect, the fourth possible implementation manner of the first aspect, or the fifth possible implementation manner of the first aspect, in a sixth possible implementation manner, the first waveguide further includes a first feeding part and a first feeding window that are interconnected, the first feeding window is located on a side wall of the first resonant cavity, the first feeding part is a waveguide section of the first waveguide, and the first feeding part is connected to the first resonant cavity by the first feeding window; and the second waveguide further includes a second feeding part and a second feeding window that are interconnected, the second feeding window is located on a side wall of the second resonant cavity, the second feeding part is a waveguide section of the second waveguide, and the second feeding part is connected to the second resonant cavity by the second feeding window.

With reference to the sixth possible implementation manner of the first aspect, in a seventh possible implementation manner, the first feeding window is parallel to the second feeding window, and an included angle between the line connecting of the circle center of the first resonant cavity and the circle center of the second resonant cavity and a direction perpendicular to the first feeding window is $\alpha$, where $90° \geq \alpha \geq 45°$.

With reference to the seventh possible implementation manner of the first aspect, in an eighth possible implementation manner, a width of the first feeding part and a width of the second feeding part is greater than a width corresponding to a cut-off frequency.

According to the waveguide filter provided by the embodiment of the present invention, a first waveguide and a second waveguide are isolated from each other by a metal isolation layer, the first waveguide forms a first resonant cavity, the second waveguide forms a second resonant cavity, the first resonant cavity and the second resonant cavity overlap each other, and a coupling slot is disposed at the metal isolation layer in an overlapping area, so that the first resonant cavity and the second resonant cavity that are disposed one above the other are coupled and connected by the coupling slot disposed in the overlapping area, adaptation between the first waveguide and the second waveguide is also implemented by using the coupling slot, and the waveguide filter is formed, where no other transition structures are added in an adaptation process, a circuit structure is relatively simple, and a circuit loss is low.

BRIEF DESCRIPTION OF THE DRAWINGS

To describe the technical solutions in the embodiments of the present invention more clearly, the following briefly introduces the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Figure 1:
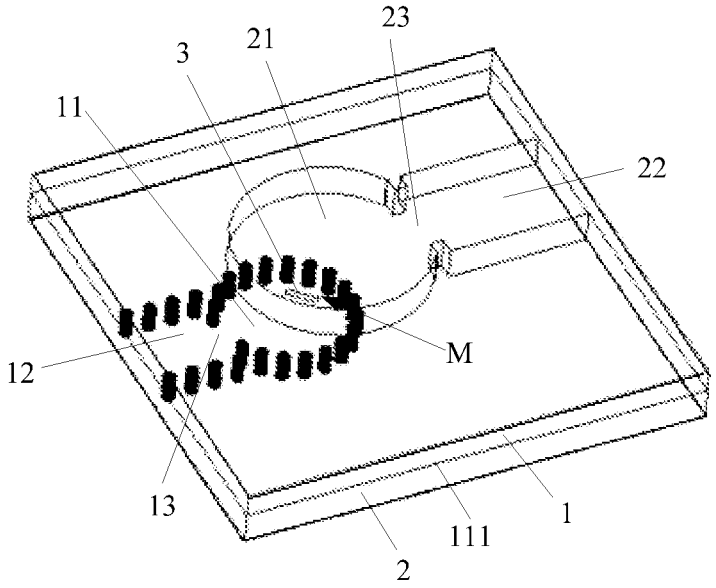
FIG. 1 is a schematic structural diagram of a waveguide filter according to an embodiment of the present invention.
Figure 4:
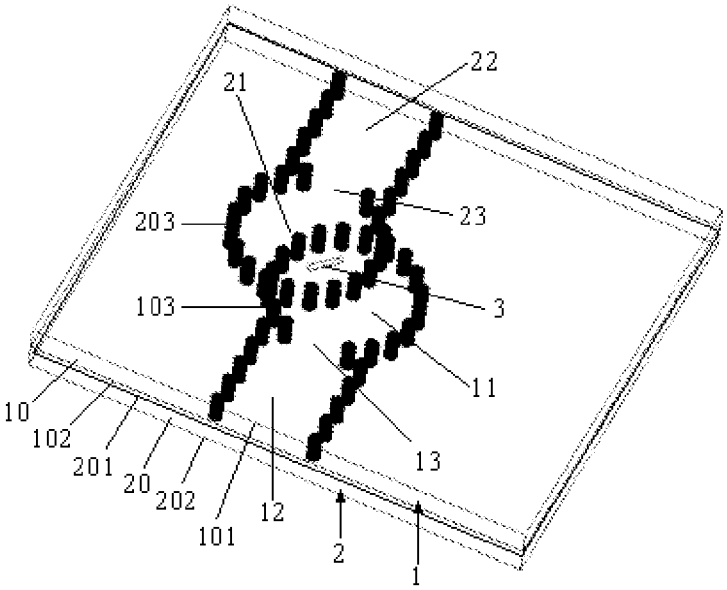
FIG. 4 is another schematic structural diagram of a waveguide filter according to an embodiment of the present invention.

As shown in FIG. 1 and FIG. 4, an embodiment of the present invention provides a waveguide filter, where the waveguide filter includes a first waveguide 1 at an upper layer and a second waveguide 2 at a lower layer, the first waveguide 1 and the second waveguide 2 are isolated from each other by a metal isolation layer 111, the first waveguide 1 forms a first resonant cavity 11, and the second waveguide 2 forms a second resonant cavity 21, the first resonant cavity 11 and the second resonant cavity 21 overlap each other, and a coupling slot 3 is disposed at the metal isolation layer 111 in an overlapping area M.

According to the waveguide filter provided by the embodiment of the present invention, a first waveguide 1 and a second waveguide 2 are isolated from each other by a metal isolation layer 111, the first waveguide 1 forms a first resonant cavity 11, the second waveguide 2 forms a second resonant cavity 21, the first resonant cavity 11 and the second resonant cavity 21 overlap each other, and a coupling slot 3 is disposed at the metal isolation layer 111 in an overlapping area M, so that the first resonant cavity 11 and the second resonant cavity 21 that are disposed one above the other are coupled and connected by the coupling slot 3 disposed in the overlapping area, and adaptation between the first waveguide 1 and the second waveguide 2 is also implemented by using the coupling slot 3, where no other transition structures are added in an adaptation process, a circuit structure is relatively simple, and a circuit loss is low.

It can be understood that in the foregoing embodiment, it may also be that the first waveguide is at the lower layer, the second waveguide is at the upper layer, and the first waveguide and the second waveguide may be mechanically fastened in a manner such as by using a bolt or a conductive adhesive.

In addition, it should be noted for the foregoing embodiment that a positional relationship between the first resonant cavity and the second resonant cavity determines a form of the overlapping area, and the first resonant cavity and the second resonant cavity have the following positional relationships.

A: Overlapping completely, that is, the first resonant cavity and the second resonant cavity are completely the same in size and shape, and completely overlap when seen from above, and in this case, an overlapping area is an area covered by the first resonant cavity or the second resonant cavity, which is generally applicable to a case that the first waveguide and the second waveguide are waveguides of a same type.

B: Intersecting each other, that is, as shown in FIG. 1, the first resonant cavity 11 and the second resonant cavity 21 intersect and overlap, and an overlapping area is an area M that is covered by both the first resonant cavity 11 and the second resonant cavity 21, which is applicable to a case that the first waveguide and the second waveguide are waveguides of a same type or waveguides of different types.

Specifically, shapes, sizes, and the positional relationship of the first resonant cavity and the second resonant cavity need to be determined by using a simulation result obtained by simulation software, where conditions on which simulation depends include a working mode of the filter (for example, a dominant mode or a dual mode), a frequency range of an electromagnetic wave that is allowed to pass, and a coupling coefficient of the first resonant cavity and the second resonant cavity.

Preferably, both the first resonant cavity and the second resonant cavity are circular. In this way, the filter can work in a TM110 mode (TM110 is one of resonant modes of a resonant cavity, and for a circular waveguide resonant cavity, represents a distribution of an electromagnetic field at a higher order mode).

Figure 5:
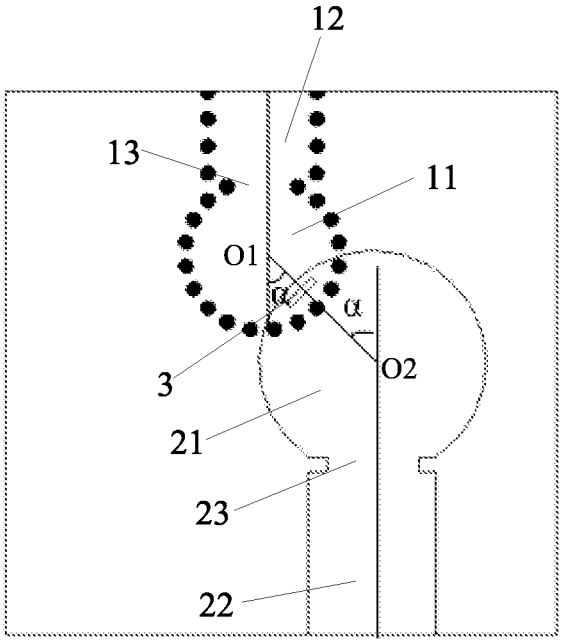
FIG. 5 is a top view of the waveguide filter shown in FIG. 1.

Preferably, as shown in FIG. 5, the coupling slot 3 is disposed at a central position of the overlapping area, and an extension direction of the coupling slot 3 is perpendicular to a line connecting a circle center O1 of the first resonant cavity 11 and a circle center O2 of the second resonant cavity 21. A reason is that getting closer to the central position of the overlapping area indicates a larger coupling coefficient of the filter and more energy coupling between the resonant cavities of the filter. In actual design, a size and a position of the coupling slot need to be optimized by using simulation software, so as to achieve a theoretically satisfying coupling coefficient. Similarly, that the extension direction of the coupling slot 3 is perpendicular to the line connecting the circle center O1 of the first resonant cavity 11 and the circle center O2 of the second resonant cavity 21 is more conducive to energy coupling and transmission between two waveguides and determining of the coupling coefficient.

As shown in FIG. 1 to FIG. 5, the first waveguide 1 further includes a first feeding part 12 and a first feeding window 13 that are interconnected, the first feeding window 13 is on a side wall of the first resonant cavity 11, the first feeding part 12 is a first waveguide section of the first waveguide 1, and the first feeding part 12 is connected to the first resonant cavity 11 by the first feeding window 13; and the second waveguide 2 further includes a second feeding part 22 and a second feeding window 23 that are interconnected, the second feeding window 23 is disposed on a side wall of the second resonant cavity 21, the second feeding part 22 is a second waveguide section disposed on the second waveguide 2, and the second feeding part 22 is connected to the second resonant cavity 21 by the second feeding window 23. In this way, feeding the filter may be performed at the first feeding part or the second feeding part. When the feeding is performed at the first feeding part, an electromagnetic wave passes through the first feeding window, the first resonant cavity, the second resonant cavity, and finally the second feeding window, and is output from the second feeding part. When the feeding is performed at the second feeding part, an electromagnetic wave passes through the second feeding window, the second resonant cavity, the first resonant cavity, and finally the first feeding window, and is output from the first feeding part. Certainly, the present invention is not limited to this. Alternatively, the first feeding window may be disposed on an upper surface of the first resonant cavity, and the second feeding window may be disposed on a lower surface of the second resonant cavity, so that feeding may be performed on an upper part or a bottom part of the filter.

A width of the first feeding part and a width of the second feeding part that are in the foregoing embodiment are preferably greater than a width corresponding to a cut-off frequency, so as to ensure purity of a filtered wave.

Preferably, the first feeding window is parallel to the second feeding window, and an included angle between the line connecting the circle center of the first resonant cavity and the circle center of the second resonant cavity and a direction perpendicular to the first feeding window is $\alpha$, where $90° \geq \alpha \geq 45°$. This is conducive to excitation of the dual mode, so that the filter works in the dual mode. When the first resonant cavity and the second resonant cavity are in the relationship of overlapping completely, the circle center O1 coincides with the circle center O2, and in this case, a positional relationship between the first feeding window and the second feeding window needs to be correspondingly adjusted to excite the dual mode.

In addition, a filter based on a metal waveguide and a filter based on a substrate integrated waveguide generally have advantages such as a high Q value (Quality factor, quality factor), a low loss, and desirable selectivity. Further, the filter based on a substrate integrated waveguide further has such advantages of a planar circuit as being easily integrated and conveniently manufactured, resulting in great suitability for design and mass production of microwave and millimeter wave integrated circuits. Therefore, the first waveguide in the foregoing embodiment may be a substrate integrated waveguide or a metal waveguide, and the second waveguide may also be a substrate integrated waveguide or a metal waveguide. Specific combination and adaptation forms are as follows.

1. When the first waveguide is a substrate integrated waveguide, and the second waveguide is a metal waveguide, the first waveguide and the second waveguide form, after adaptation, a waveguide filter shown in FIG. 1.

Figure 2:
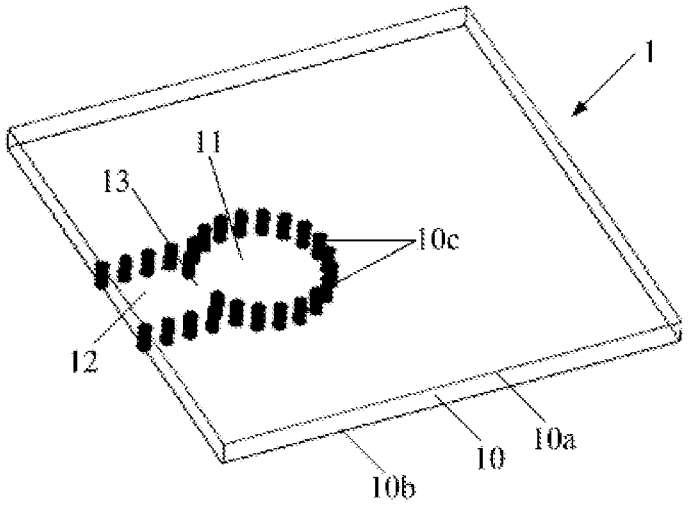
FIG. 2 is a schematic structural diagram of a first waveguide shown in FIG. 1.

In this case, the first waveguide is preferably a substrate integrated waveguide shown in FIG. 2, and includes a dielectric substrate 10, a first metal layer 10*a* covering an upper surface of the dielectric substrate 10, and a second metal layer 10*b* covering a lower surface of the dielectric substrate 10, where multiple metalized via holes 10*c* that run through the first metal layer 10*a*, the dielectric substrate 10, and the second metal layer 10*b* are disposed in the dielectric substrate 10, and the dielectric substrate 10, the metalized via holes 10*c*, the first metal layer 10*a*, and the second metal layer 10*b* form the first resonant cavity 11. The second waveguide is preferably a metal waveguide, with a pierced upper part, shown in FIG. 3, and the second metal layer 10*b* and a cavity inside the second waveguide form the second resonant cavity 21. The metalized via holes 10*c* may be manufactured by using a common printed circuit board (PCB) technology.

Figure 3:
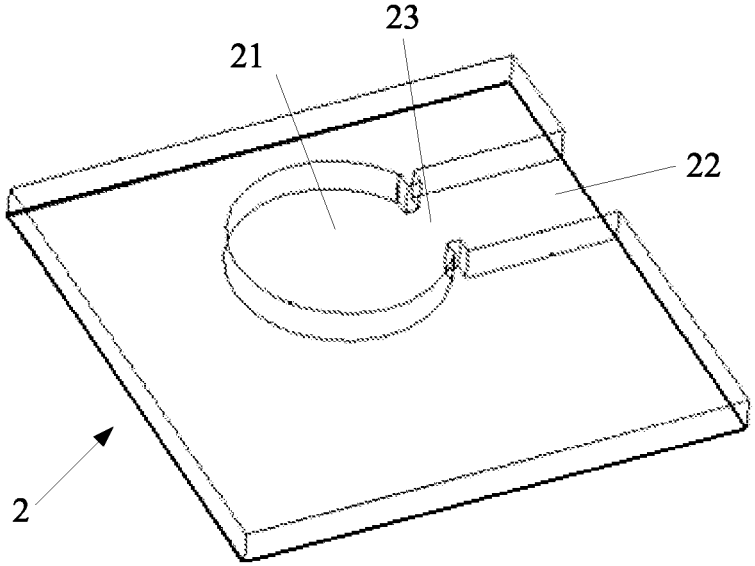
FIG. 3 is a schematic structural diagram of a second waveguide shown in FIG. 1.

In this embodiment, a specific adaptation method for adaptation between the first waveguide and the second waveguide may be: firstly, removing a metal layer on an upper surface of a hollow metal waveguide (or directly machining a metal waveguide of a structure with a pierced upper part, as shown in FIG. 3), and disposing the coupling slot 3 at a corresponding position at the second metal layer 10*b* on a lower surface of the substrate integrated waveguide (the coupling slot may be manufactured by using the common printed circuit board technology); secondly, superposing the substrate integrated waveguide on the metal waveguide, and making the substrate integrated waveguide and the metal waveguide fit closely; and finally, mechanically fastening the first waveguide and the second waveguide in a manner such as by using a bolt or a conductive adhesive.

A result of combination is that the substrate integrated waveguide at an upper layer and the metal waveguide at a lower layer are isolated from each other by the second metal layer 10*b*, that is, a metal isolation layer, and the first resonant cavity and the second resonant cavity are coupled and connected by the coupling slot. In this way, adaptation between the substrate integrated waveguide and the metal waveguide is implemented by using the coupling slot, so as to form the waveguide filter shown in FIG. 1, and adaptation between waveguides of different types is implemented, where an adaptation structure is simple.

2. When both the first waveguide and the second waveguide are substrate integrated waveguides, the first waveguide and the second waveguide form, after adaptation, a waveguide filter shown in FIG. 4.

In this case, the first waveguide 1 includes a first dielectric substrate 10, an upper surface of the first dielectric substrate 10 is covered by a first metal layer 101, a lower surface of the first dielectric substrate 10 is covered by a second metal layer 102, multiple first metalized via holes 103 that run through the first metal layer 101, the first dielectric substrate 10, and the second metal layer 102 are disposed in the first dielectric substrate 10, and the first dielectric substrate 10, the multiple first metalized via holes 103, the first metal layer 101, and the second metal layer 102 form the first resonant cavity 11.

The second waveguide 2 includes a second dielectric substrate 20, an upper surface of the second dielectric substrate 20 is covered by a third metal layer 201, a lower surface of the second dielectric substrate 20 is covered by a fourth metal layer 202, multiple second metalized via holes 203 that run through the third metal layer 201, the second dielectric substrate 20, and the fourth metal layer 202 are disposed in the second dielectric substrate 20, and the second dielectric substrate 20, the multiple second metalized via holes 203, the third metal layer 201, and the fourth metal 202 layer form the second resonant cavity 21.

In this way, the metal isolation layer is the second metal layer 102 and the third metal layer 201.

A specific adaptation method of the first waveguide and the second waveguide is: firstly, disposing the coupling slot 3 at a corresponding position that is at the second metal layer 102 on a lower surface of the first waveguide 1 and at the third metal layer 201 on an upper surface of the second waveguide 2, where the coupling slot runs through the second metal layer 102 and the third metal layer 201; secondly, stacking the two substrate integrated waveguides together, and making the two substrate integrated waveguides fit closely; and finally, mechanically fastening the two substrate integrated waveguides in a manner such as by using a bolt or a conductive adhesive.

A result of combination is that the first waveguide and the second waveguide are isolated from each other by the second metal layer on the lower surface of the first waveguide and the third metal layer on the upper surface of the second waveguide, and the first resonant cavity and a second resonant cavity are coupled and connected by the coupling slot. In this way, adaptation between the first waveguide and the second waveguide is implemented by using the coupling slot, so as to form the waveguide filter shown in FIG. 4, and adaptation between waveguides of a same type is implemented, where an adaptation structure is simple.

3. An adaptation structure in a case in which both the first waveguide and the second waveguide are metal waveguides.

In this case, the first waveguide is a hollow metal waveguide, and a cavity inside the first waveguide forms the first resonant cavity; the second waveguide is a metal waveguide with a pierced upper part, and a metal layer on a lower surface of the first waveguide and a cavity inside the second waveguide form the second resonant cavity; and the metal isolation layer is the metal layer on the lower surface of the first waveguide.

A specific adaptation method of the first waveguide and the second waveguide is: firstly, removing a metal layer on an upper surface of the hollow metal waveguide (or directly machining, during manufacturing, a metal waveguide of a structure with a pierced upper part) to obtain the second waveguide; and disposing a coupling slot at a corresponding position at the metal layer on the lower surface of the first waveguide (that is, the hollow metal waveguide); secondly, stacking the two metal waveguides together, and making the two metal waveguides fit closely; and finally, mechanically fastening the two metal waveguides in a manner such as by using a bolt or a conductive adhesive. The first resonant cavity and the second resonant cavity are isolated from each other by one metal layer, and are coupled and connected by the coupling slot disposed at the metal layer. In this way, adaptation between the first waveguide and the second waveguide is implemented by using the coupling slot, so as to form the waveguide filter, and adaptation between waveguides of a same type is implemented, where an adaptation structure is simple.

4. An adaptation structure in a case in which the first waveguide is a metal waveguide, and the second waveguide is a substrate integrated waveguide. The adaptation structure is similar to the adaptation structure in which the first waveguide is a substrate integrated waveguide and the second waveguide is a metal waveguide, and a difference lies in that a first resonant cavity is a metal waveguide with a pierced lower part.

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A waveguide filter comprising:

a first waveguide at an upper layer, the first waveguide forming a first resonant cavity;

a second waveguide at a lower layer, the second waveguide forming a second resonant cavity, wherein the first resonant cavity and the second resonant cavity overlap each other;

a metal isolation layer configured to isolate the first waveguide from the second waveguide; and a coupling slot disposed at the metal isolation layer in an overlapping area;

wherein at least one of the first waveguide and the second waveguide comprises a dielectric substrate having an upper surface covered by a first metal layer and a lower surface covered by a second metal layer, and wherein the respective waveguide of the at least one of the first waveguide and the second waveguide has multiple via holes extending through the first metal layer, the dielectric substrate, and the second metal layer, and wherein the dielectric substrate, the multiple via holes, the first metal layer, and the second metal layer form the respective resonant cavity of the respective waveguide.

2. The waveguide filter according to claim 1, wherein the first waveguide comprises the dielectric substrate, the first metal layer, and the second metal layer, and wherein the multiple via holes comprise multiple metalized via holes that run through the first metal layer, the dielectric substrate and the second metal layer, and wherein the dielectric substrate, the multiple metalized via holes, the first metal layer, and the second metal layer form the first resonant cavity;

wherein the second waveguide is a metal waveguide with a pierced upper part, and the second metal layer and a cavity inside the second waveguide form the second resonant cavity; and wherein the metal isolation layer is the second metal layer.

3. The waveguide filter according to claim 1, wherein the first waveguide and the second waveguide each comprise the dielectric substrate, wherein the multiple via holes are multiple metalized via holes; wherein the dielectric substrate of the first waveguide is a first dielectric substrate, wherein the first waveguide further comprises the first metal layer and the second metal layer, wherein the first waveguide has multiple first metalized via holes of the multiple metalized via holes, wherein the multiple first metalized via holes run through the first metal layer, the first dielectric substrate and the second metal layer, and wherein the first dielectric substrate, the multiple first metalized via holes, the first metal layer, and the second metal layer form the first resonant cavity;

wherein the dielectric substrate of the second waveguide is a second dielectric substrate, an upper surface of the second dielectric substrate is covered by a third metal layer, wherein a lower surface of the second dielectric substrate is covered by a fourth metal layer, wherein the second waveguide has multiple second metalized via holes of the multiple metalized via holes, wherein the multiple second metalized via holes run through the third metal layer, the second dielectric substrate and the fourth metal layer, and wherein the second dielectric substrate, the multiple second metalized via holes, the third metal layer, and the fourth metal layer form the second resonant cavity; and the metal isolation layer is the second metal layer and the third metal layer.

4. The waveguide filter according to claim 1, wherein the second waveguide is a metal waveguide with a pierced upper part, and wherein the second metal layer on the lower surface of the first waveguide and a cavity inside the second waveguide form the second resonant cavity; and wherein the metal isolation layer is the second metal layer on the lower surface of the first waveguide.

5. The waveguide filter according to claim 1, wherein both the first resonant cavity and the second resonant cavity are circular.

6. The waveguide filter according to claim 5, wherein the coupling slot is located at a central position of the overlapping area, and an extension direction of the coupling slot is perpendicular to a line connecting a circle center of the first resonant cavity and a circle center of the second resonant cavity.

7. The waveguide filter according to claim 1, wherein the first waveguide further comprises a first feeding part and a first feeding window that are interconnected, the first feeding window is located on a side wall of the first resonant cavity, the first feeding part is a waveguide section of the first waveguide, and the first feeding part is connected to the first resonant cavity by the first feeding window; and wherein the second waveguide further comprises a second feeding part and a second feeding window that are interconnected, the second feeding window is located on a side wall of the second resonant cavity, the second feeding part is a waveguide section of the second waveguide, and the second feeding part is connected to the second resonant cavity by the second feeding window.

8. The waveguide filter according to claim 7, wherein the first feeding window is parallel to the second feeding window, and an included angle between a line connecting a circle center of the first resonant cavity and a circle center of the second resonant cavity and a direction perpendicular to the first feeding window is $\alpha$, wherein $90° \geq \alpha \geq 45°$.

9. The waveguide filter according to claim 8, wherein a width of the first feeding part and a width of the second feeding part are greater than a width corresponding to a wavelength of a predetermined cut-off frequency of the waveguide filter.

10. A waveguide filter comprising:

a first waveguide having a first resonant cavity;

a second waveguide having a second resonant cavity, wherein the first resonant cavity and the second resonant cavity overlap each other in an overlapping area;

a metal isolation layer disposed between the first waveguide and the second waveguide; and a coupling slot in the metal isolation layer, wherein the coupling slot is disposed in the overlapping area;

wherein the first waveguide comprises a dielectric substrate having an upper surface covered by a first metal layer and a lower surface covered by a second metal layer that is the metal isolation layer, and wherein the first waveguide has multiple via holes extending through the first metal layer, the dielectric substrate, and the second metal layer, and wherein the dielectric substrate, the multiple via holes, the first metal layer, and the second metal layer form the first resonant cavity.

11. The waveguide filter according to claim 10, wherein the multiple via holes are multiple metalized via holes.

12. The waveguide filter according to claim 10, wherein the second waveguide is a metal waveguide with a pierced upper part, and wherein the second metal layer on the lower surface of the first waveguide and a cavity inside the second waveguide form the second resonant cavity; and wherein the metal isolation layer is the second metal layer on the lower surface of the first waveguide.

13. The waveguide filter according to claim 10, wherein both the first resonant cavity and the second resonant cavity are circular.

14. The waveguide filter according to claim 13, wherein the coupling slot is located at a central position of the overlapping area, and an extension direction of the coupling slot is perpendicular to a line connecting a circle center of the first resonant cavity and a circle center of the second resonant cavity.

15. The waveguide filter according to claim 10, wherein the first waveguide further comprises a first feeding part and a first feeding window that are interconnected, the first feeding window is located on a side wall of the first resonant cavity, the first feeding part is a waveguide section of the first waveguide, and the first feeding part is connected to the first resonant cavity by the first feeding window; and wherein the second waveguide further comprises a second feeding part and a second feeding window that are interconnected, the second feeding window is located on a side wall of the second resonant cavity, the second feeding part is a waveguide section of the second waveguide, and the second feeding part is connected to the second resonant cavity by the second feeding window.

16. The waveguide filter according to claim 15, wherein the first feeding window is parallel to the second feeding window, and an included angle between a line connecting a circle center of the first resonant cavity and a circle center of the second resonant cavity and a direction perpendicular to the first feeding window is $\alpha$, wherein $90° \geq \alpha \geq 45°$.

17. A waveguide filter comprising:

a first waveguide having a first resonant cavity, wherein the first waveguide comprises a first dielectric substrate having an upper surface covered by a first metal layer and a lower surface covered by a second metal layer, and wherein the first waveguide has multiple first via holes extending through the first metal layer, the first dielectric substrate, and the second metal layer, and wherein the first dielectric substrate, the multiple first via holes, the first metal layer, and the second metal layer form the first resonant cavity;

a second waveguide having a second resonant cavity, wherein the first resonant cavity and the second resonant cavity overlap each other in an overlapping area, wherein the second waveguide comprises a second dielectric substrate, wherein an upper surface of the second dielectric substrate is covered by a third metal layer, wherein a lower surface of the second dielectric substrate is covered by a fourth metal layer, wherein multiple second via holes run through the third metal layer, the second dielectric substrate, and the fourth metal layer, and wherein the second dielectric substrate, the multiple second via holes, the third metal layer, and the fourth metal layer form the second resonant cavity; and wherein the second metal layer and the third metal layer form a metal isolation layer disposed between the first waveguide and the second waveguide, and wherein the metal isolation layer has a coupling slot in the overlapping area.

18. The waveguide filter according to claim 17, wherein the multiple first via holes are multiple metalized first via holes, and wherein the multiple second via holes are multiple metalized second via holes.

19. The waveguide filter according to claim 17, wherein both the first resonant cavity and the second resonant cavity are circular; and wherein the coupling slot is located at a central position of the overlapping area, and an extension direction of the coupling slot is perpendicular to a line connecting a circle center of the first resonant cavity and a circle center of the second resonant cavity.

20. The waveguide filter according to claim 17, wherein the first waveguide further comprises a first feeding part and a first feeding window that are interconnected, the first feeding window is located on a side wall of the first resonant cavity, the first feeding part is a waveguide section of the first waveguide, and the first feeding part is connected to the first resonant cavity by the first feeding window; and wherein the second waveguide further comprises a second feeding part and a second feeding window that are interconnected, the second feeding window is located on a side wall of the second resonant cavity, the second feeding part is a waveguide section of the second waveguide, and the second feeding part is connected to the second resonant cavity by the second feeding window; and wherein the first feeding window is parallel to the second feeding window, and an included angle between a line connecting a circle center of the first resonant cavity and a circle center of the second resonant cavity and a direction perpendicular to the first feeding window is $\alpha$, wherein $90° \geq \alpha \geq 45°$.

* * * * *